US005683209A

United States Patent [19]

Costley, Jr.

[11] Patent Number: 5,683,209

[45] Date of Patent: Nov. 4, 1997

[54] MARINE BI-PLANE ANCHOR

[76] Inventor: John L. Costley, Jr., 8101 Washita Dr., Austin, Tex. 78749-3817

[21] Appl. No.: 12,047

[22] Filed: Feb. 1, 1993

[51] Int. Cl.[6] ..... B63B 21/32

[52] U.S. Cl. ..... 114/301; 114/295

[58] Field of Search ..... 114/294, 295, 114/301, 302, 303

[56] References Cited

U.S. PATENT DOCUMENTS

| | | | |
|---|---|---|---|
| 3,118,416 | 1/1964 | Sawyer | 114/305 |
| 3,505,969 | 4/1970 | Bowers | 114/304 |
| 3,618,554 | 11/1971 | Patten | 114/305 |
| 3,822,664 | 7/1974 | Hedman | 114/305 |
| 3,964,421 | 6/1976 | Van Den Haak | 114/309 |
| 3,977,351 | 8/1976 | Watterback | 114/294 |
| 4,029,040 | 6/1977 | Klaren | 114/304 |
| 4,058,078 | 11/1977 | Stelling | 114/304 |
| 4,089,288 | 5/1978 | Van Den Haak | 114/304 |
| 4,154,186 | 5/1979 | Van Den Haak | 114/304 |
| 4,154,187 | 5/1979 | Taylor | 114/304 |
| 4,173,938 | 11/1979 | Colin | 114/294 |
| 4,394,842 | 7/1983 | Van Den haak | 114/304 |
| 4,907,523 | 3/1990 | Claesson | 114/301 |

*Primary Examiner*—Jesus D. Sotelo

[57] ABSTRACT

An anchor comprising an exterior bale and having two fluke planes in a horizontal plane that lie vertically parallel and in a horizontal plane are separated by vertical ribs uniting the horizontal planes at an angle of 90° and forming with them open spaces between the fluke planes that allow the passage of marine floor material through the entire length of the fluke planes area. Stops elements are to either side of the fluke plane and control the burial angle rotation of the fluke in relationship to the bale.

3 Claims, 8 Drawing Sheets

MARINE BI-PLANE ANCHOR

DESCRIPTION OF PRIOR ART

U.S. Pat. No. 4,173,938 Colin Sep. 2, 1979; Colin's drawing FIG. 9 has a bale but differs in position in the arrangement of the flukes and the arrangement for embedment from the Marine Bi-Plane Anchor.

U.S. Pat. No. 4,907,523 Claesson Mar. 13, 1990: Claesson has the arrangement of the boxed sections in his design to a different arrangement and the pulled shaft splits the fluke plane area where the Marine Bi-Plane Anchor uses a bale and does not split the area of the fluke plane.

U.S. Pat. No. 3,505,969 Bowers Apr. 14, 1973: Bowers has designed the bale interior in arrangement to the flukes and the flukes have a break in the lengthwise distance that differs in arrangement to the Marine Bi-Plane Anchor whose fluke length does not follow this arrangement.

U.S. Pat. No. 4,029,040 Klaren Jun. 14, 1977: Klaren has the planes of the anchor's base not in a parallel to each other and has divided the fluke plane area with a central stop. The Marine Bi-Plane Anchor has external stops, vertical ribs that tie the vertically parallel fluke planes together and an open area between the fluke planes area to allow the flow of material through the fluke planes.

U.S. Pat. No. 4,058,078 Stelling Nov. 15, 1977: Stelling has a design where there are multiple planes but none are boxed nor do they follow the arrangement of the Marine Bi-Plane Anchor.

U.S. Pat. No. 4,089,288 Van Den Haak May 16, 1978: Van Den Haak has two small stabilizers that do not go fully across the fluke plane area and are of a different arrangement to the Marine Bi-Plane Anchor.

U.S. Pat. No. 4,154,186 Van Den Hank May 15, 1979: Van Den Haak has boxed sections but in this application they are used to shape the final form of the fluke plane and are not open to the flow of material through the boxed section's area and are not of equal size across the width of the fluke plane and this makes as large difference in the arrangement compared to the Marine Bi-Plane Anchor.

U.S. Pat. No. 4,154,187 Taylor May 15, 1979: Taylor's arrangement has one single fluke plane and has no boxed sections nor openings like those found in the Marine Bi-Plane Anchor.

U.S. Pat. No. 4,394,842 Van Den Haak Jul. 26, 1983: Van Den Haak in this design has not boxed the fluke plane area for the width of that area nor has he exposed the boxed sections of this anchor to the flow of material in the ways that the Marine Bi-Plane Anchor does.

U.S. Pat. No. 3,977,351 Watterback Jul. 2, 1975: Watterback has a bale but the deployment of the flukes are not in a manner that has a boxed section opening and the flukes may bury at an angle wider that that of the bale and the fluke planes are not tied together by vertical ribs to keep the same alignment of the flake planes while engagement of the soil is occurring in the burial process. This differs substantially from the Marine Bi-Plane Anchor.

U.S. Pat. No. 3,118,416 Sawyer Jan. 21, 1964: Sawyer has a sled type of arrangement and the boxed sections of the anchor are not open thereby to the flow of material through the boxed sections as is allowed in the Marine Bi-Plane Anchor.

U.S. Pat. No. 3,618,554 Patten Nov. 9, 1971: Patten has swing/rotate internal members for the stops and folding elements not found in the Marine Bi-Plane Anchor.

U.S. Pat. No. 3,822,664 Hedman Jul. 9, 1974: Hedman has folding elements in deployment and a single fluke plane, the Marine Bi-Plane Anchor has no folding elements and dual fluke planes.

U.S. Pat. No. 3,964,421 Van Den Hank May 22, 1976: Van Den Haak has boxed sections used to form the external surface of a single flake plane and the boxed sections are not open to the flow of material, nor do the boxed sections remain at the same height across the width of the fluke plane as is found in the Marine Bi- Plane Anchor.

DESCRIPTION OF PREFERRED EMBODIMENT

Figure 1:
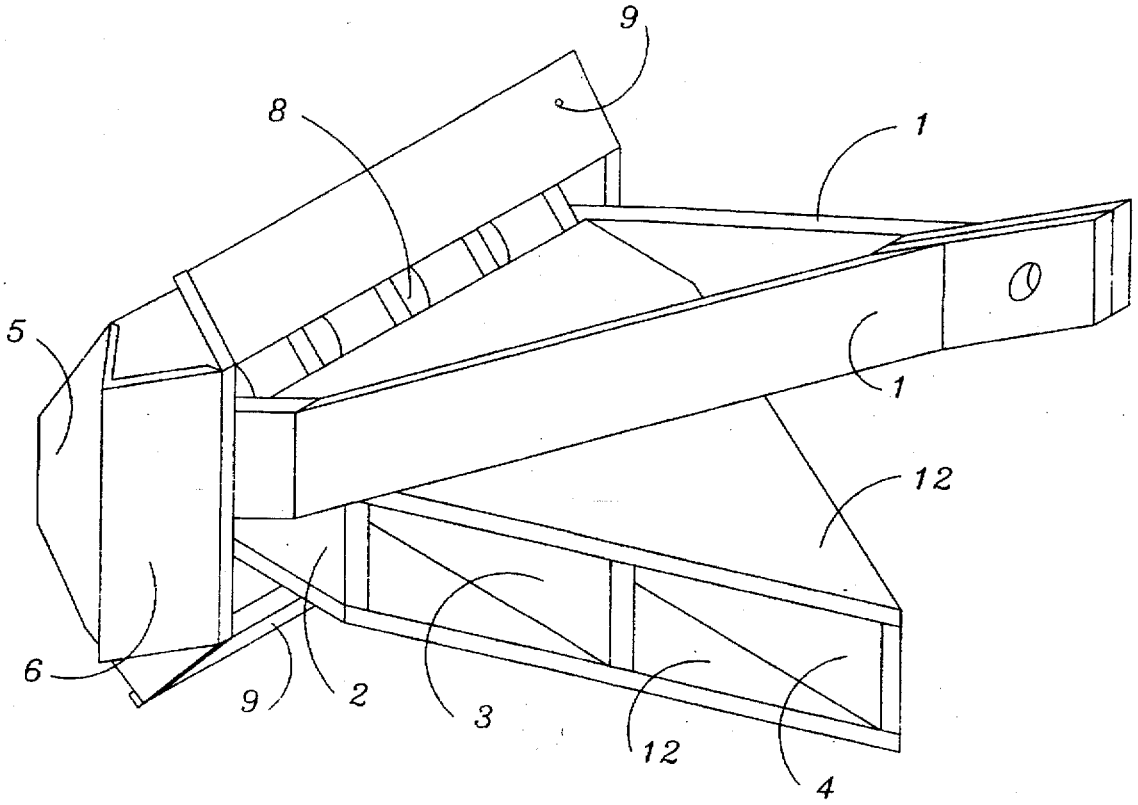
FIG. 1 is an oblique view or isosceles drawing of the complete Marine Bi-Plane Anchor.

The Marine Bi-Plane Anchor relies on several factors in its design to accomplish a burial and accumulate a mass of material in a manner that will help the mariner and help avoid loss of life and ships at sea. This invention relates to the kind of anchors which have a bale and do not have a central shank that divides the fluke planes area. An anchor of similar type is disclosed by patent #3, 997, 351 to Watterback but the Watterback patent does not have a dual fluke planes (12) nor does it allow the flow of material through the fluke planes area between the top and bottom fluke planes (12), to this end this anchor according to the present invention is characterized substantially in that during burial marine floor material flows over two distinct fluke planes (12), while at the same time the material is flowing through the area formed by the vertical ribs (2, 3, 4). The vertical ribs (2, 3, 4) are in a 90° axis to the fluke planes (12) and welded in a manner to form four separate boxed sections that add a larger mass to the burial material by allowing the flow of material through and between the area of the fluke planes (12). Adding further advantage to the deployment of the anchor is having a bale outside of the fluke planes area of the fluke planes (12). This adds an area heretofore normally separated by a central shank; thus, incurring the necessary clearance that the shank would normally require is avoided is avoided by this design. Fixing means for this anchor design are found at two points: one at the front of the bale (1),and one at the back of the central rib (4). A hole found at the back of the central rib (4) is for attachment of the pennant line and buoy common to offshore anchoring arrangements. The anchor engages the soil quickly because of the elevation difference (seen from a side view) between the hinge point of the bale (1) and the stops outermost point as viewed from the side in relation to where the two share a common axis at the shaft (8). This elevation difference causes a rocking motion to begin the burial process where the lower fluke plane (12) and the area between the boxed sections begin accumulating material almost immediately and assist in the engagement of the upper fluke plane (12). The bale (1), exterior to the area of the fluke planes (12) also may assist in the clearing of small debris as it is pulled in the burial process.

FIG. 1 is an oblique views of the Marine Bi-Plane Anchor the bale (1) does not split the area of the flukes plane and this allows a greater area of plane in one place, this combined with the lower fluke plane (12) where it is joined to the upper fluke plane (12) by the vertical ribs (2, 3, 4) that are welded in a 90° axis to join and form the boxed sections between the fluke planes (12) that are open to the flow of burial material during the burial process. The face (9) of stops plate and the elevation difference in reference to the point of the fluke plane (12) rock the anchor into an initial burial position. The outer plate of stops (5) and its angular reinforcement piece (6) keep the side deflection of the outer plate of stops (5) in place during deployment and retrieval. The bale (1) and the body of the anchor rocks in the shaft (8) during operation and hinge the two at a common axis of rotation.

Figure 2:
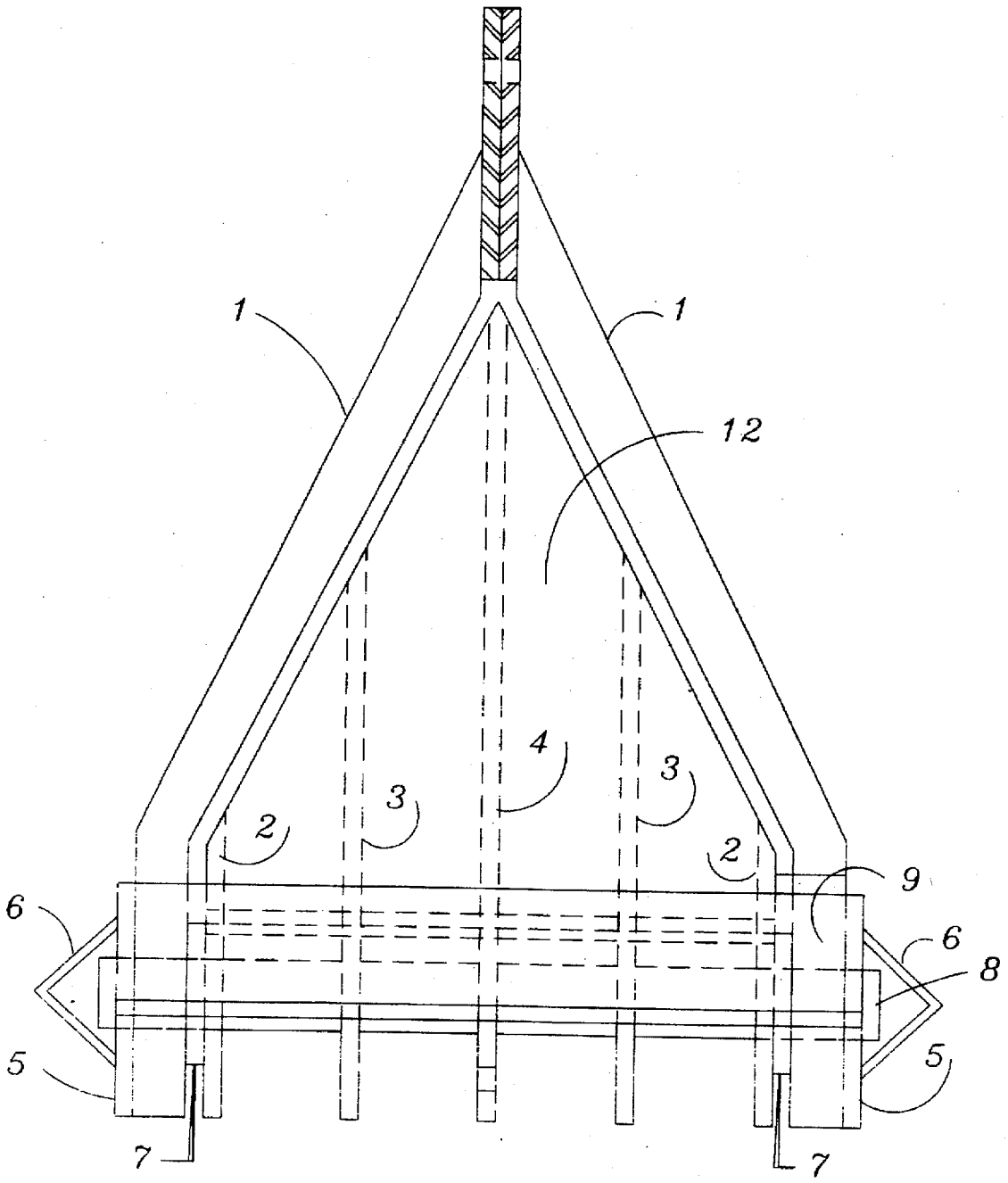
FIG. 2 is a top view of the complete Marine Bi-Plane Anchor.

FIG. 2 is a top view of the Marine Bi-Plane Anchor the bale (1) is viewed from a top perspective and only the top plane (12) of the bi-plane is viewed. The vertical view and arrangement of the vertical ribs (2, 3, 4) are shown as dotted lines under the fluke plane (12) and as solid lines at the back of the anchor. Also at the back of the central rib (4) note the hole for the attachment of the pennant/buoy line. On the outside of the outer ribs (2) are the washers (7) that are the running surface between the bale (1) and the outer ribs (2) and both on the shaft (8). This ties the body to the bale (1) and forms a rotational axis for both. The outer plate of stops (5) is shown from the top with the angular reinforcement piece (6) welded to it and their relationship to the shall (8).

Figure 3:
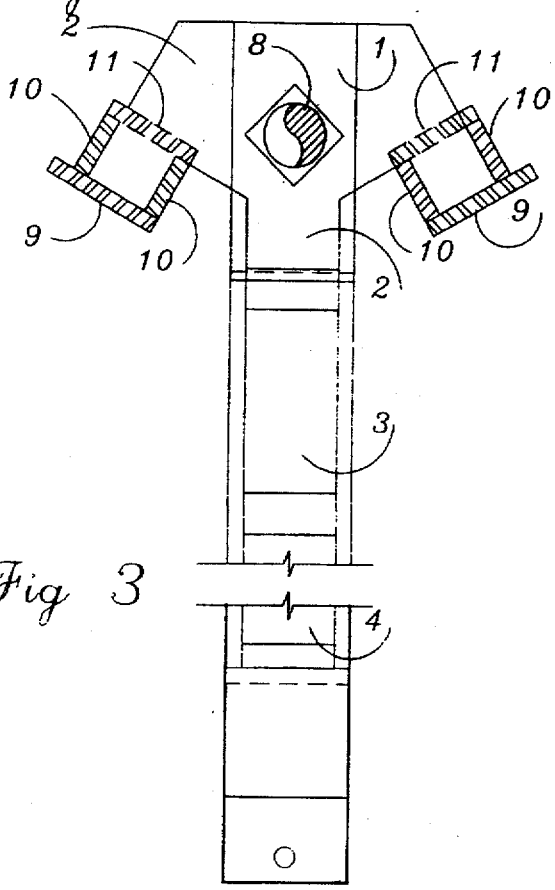
FIG. 3 is a side view of the Marine Bi-Plane Anchor.

FIG. 3 is a side view of a partially built anchor and meant to show the side view relationship of the shaft (8), the bale (1), the outer rib (2) and the pieces that are welded out to form the stops. The face of stops plate (9) faces the front of the anchor and is supported by the stops joiner plate (10) that is welded behind and to the exposed sides of the ribs (2, 3, 4) and to the back of the face of stops plate (9). Also welded out at this time are the stops spacer plates (11) that fit between the individual rib sections of the vertical ribs (2, 3, 4) and also between the outer ribs (2) and the outer plate of stops (5).

Figure 4:
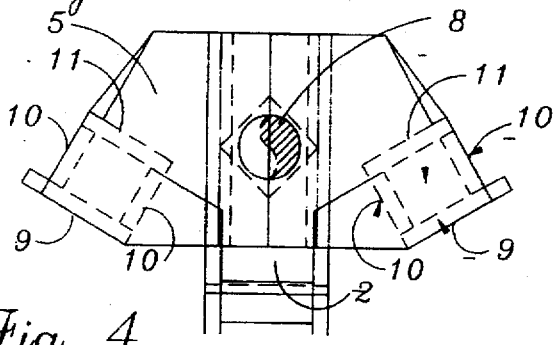
FIG. 4 is the view relative to FIG. 3 showing how the assembly process has now moved to include the outer plate stops (5), the stops joiner plate (10), stops spacer plate (11), the shaft (8), have now been covered and weldment interface of these parts leaves only the face (9) of stops plate exposed to view.

FIG. 4 augments FIG. 3 in showing how the outer plate of stops (5) look when fitted and welded out. The shaft (8) is welded to the outer plate of stops (5) and the welding of the face of stops plate (9), the stops joiner plate (10) and the stops spacer plates (11) all welded to each other and the fabrication views complete.

Figure 5:
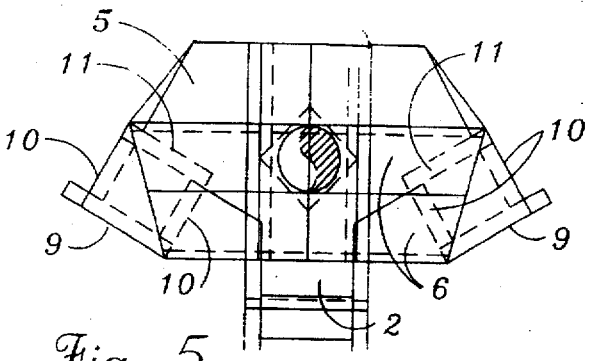
FIG. 5 is the complete view of one side of the Maxine Bi-Plane Anchor assembled with the angular reinforcement piece (6) welded to the outer plate (5) of stops and the complete interrelationship of the outer portion of the anchor from one side, face of stops plate (9), stops joiner plate (10), and stops spacer plates (11).

FIG. 5 augments FIG. 3 and FIG. 4 by showing a complete side view of the angular reinforcement piece (6) welded out to the outer plate of stops (5) and the face of stops plate (9).

Figure 8:
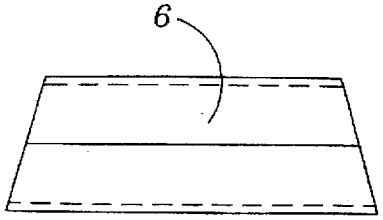
FIG. 8 is a side view of the angular reinforcement piece.
Figure 7:
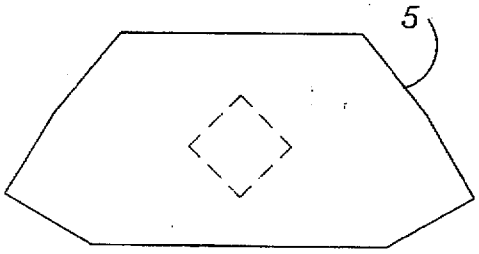
FIG. 7 is a side view of the outer plate of stops.
Figure 6:
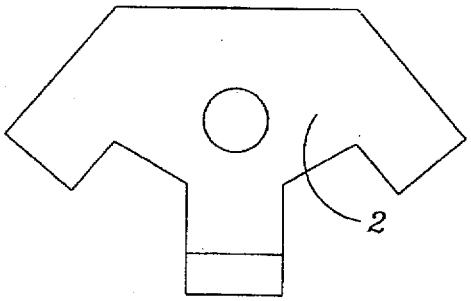
FIG. 6 is a side view of the outer ribs.

FIG. 6 the outer ribs (2) and FIG. 7 the outer plate of stops (5) and FIG. 8 the angular reinforcement piece (6) are also on this page to give a perspective of the individual parts and assist the clarity of the construction concept from a fabricators view.

Figure 9:
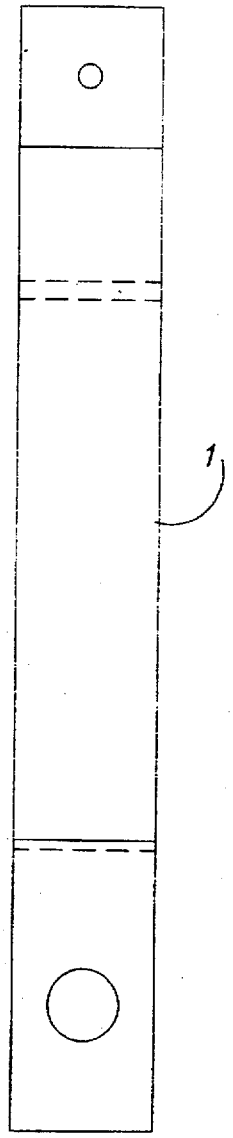
FIG. 9 is a side view of the bale.
Figure 10:
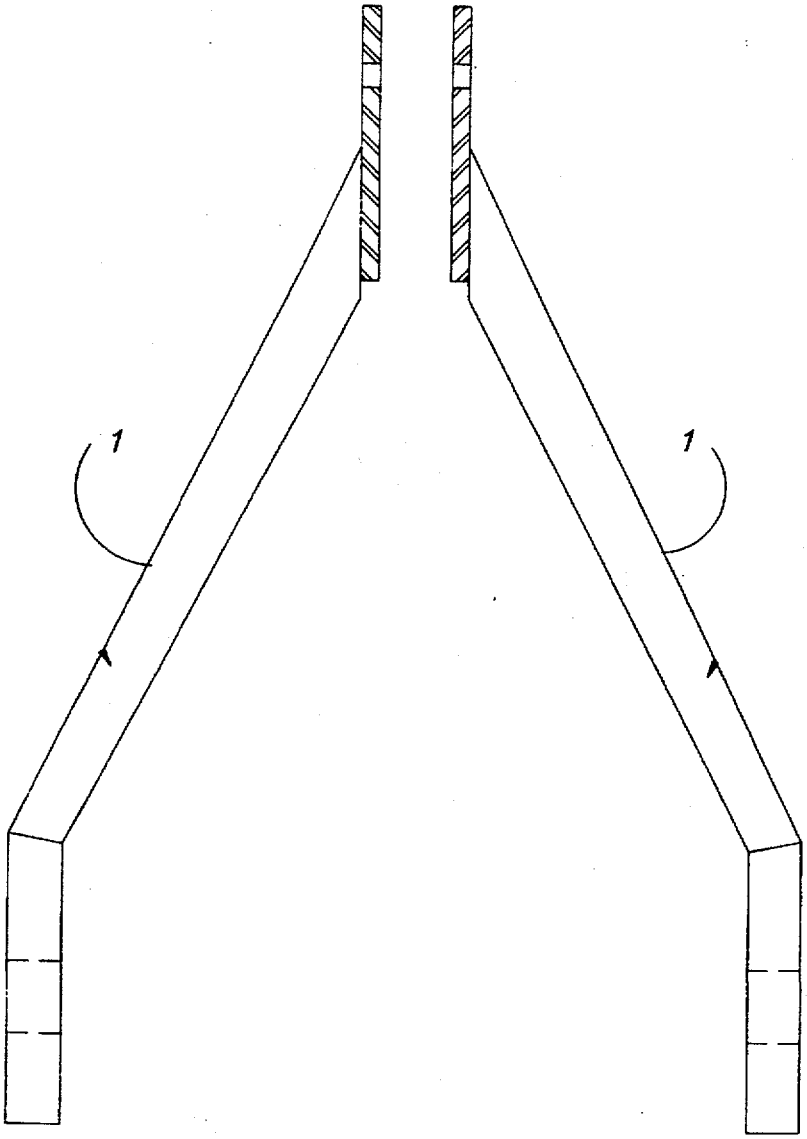
FIG. 10 is a side view of the bale.

FIG. 9 is a side view of the bale (1); FIG. 10 is a top view of the bale (1) split into components before assembly.

Figure 12:
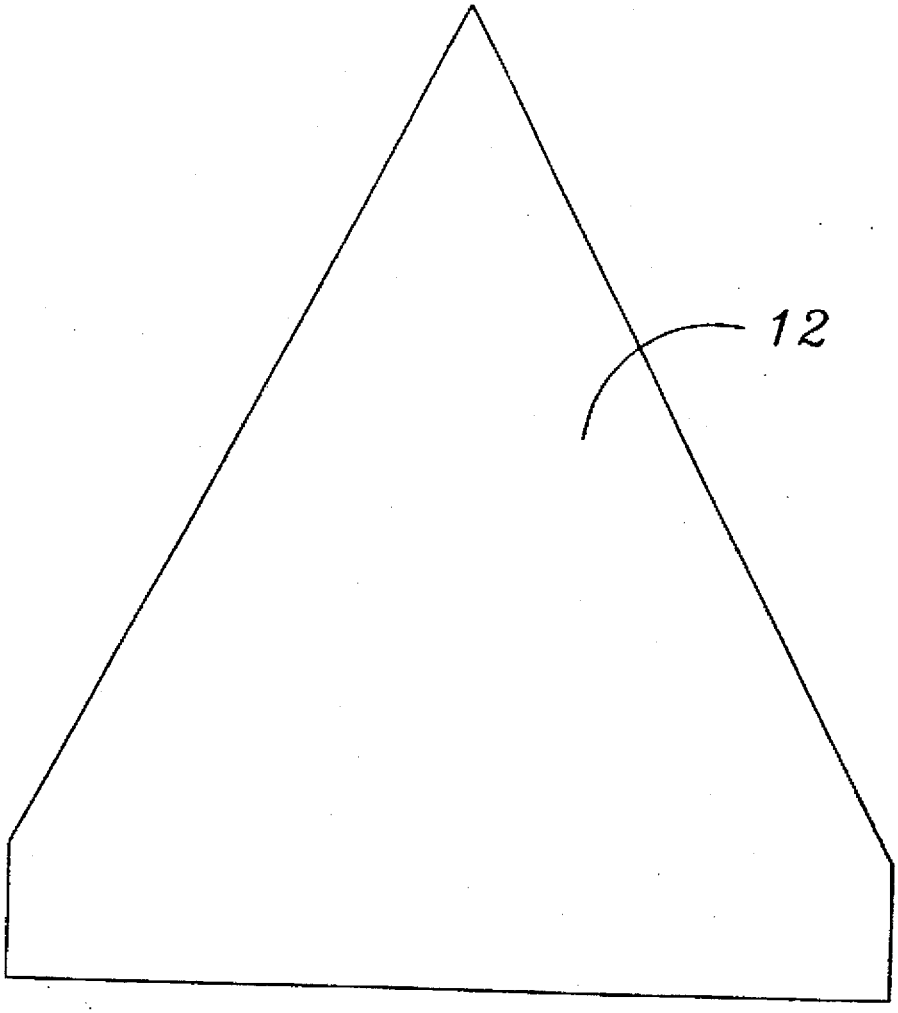
FIG. 12 is a top view of the fluke plane.
Figure 11:
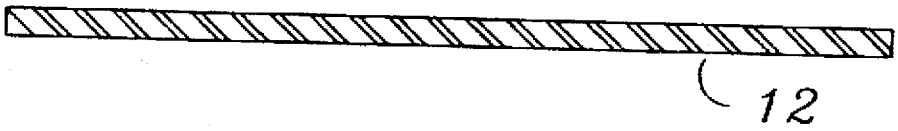
FIG. 11 is a side view of the fluke plane.

FIG. 11 is an end view of the plate used to fabricate the fluke planes ( 12 ). FIG. 12 is a top view of the same plate showing the cuts and angles that form the fluke planes (12).

Figure 14:
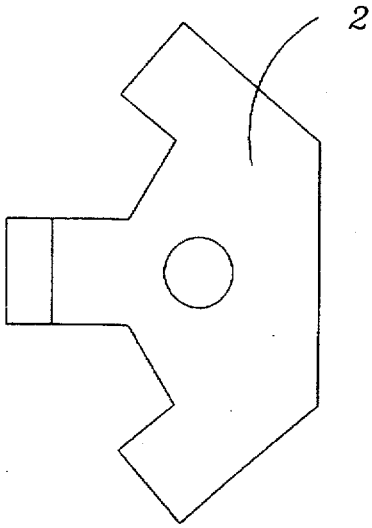
FIG. 14 is a side view of the outer ribs.
Figure 13:
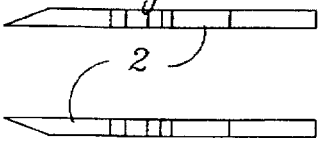
FIG. 13 is a top view of the outer ribs, the knife edges are opposite hands to reflect how they fit in final relationship to the fluke planes.
Figure 15:
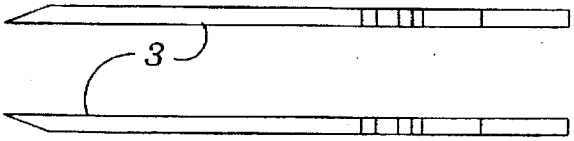
FIG. 15 is a top view of the intermediate ribs, the knife edges are opposite hands. to reflect how they fit in final relationship to the fluke planes.

FIG. 13 is a top view of the outer ribs (2), note how the cut edges are on opposite sides, this is done to accommodate the cut angle of the intersection of the rib with the outside edge of the fluke planes (12). FIG. 14 is a side view of the outer ribs (2). FIG. 15 is a top view of the intermediate ribs (3), as with the outer ribs (2) the cut edges are on opposite sides to accommodate the cut angle of the fluke planes (12).

Figure 18:
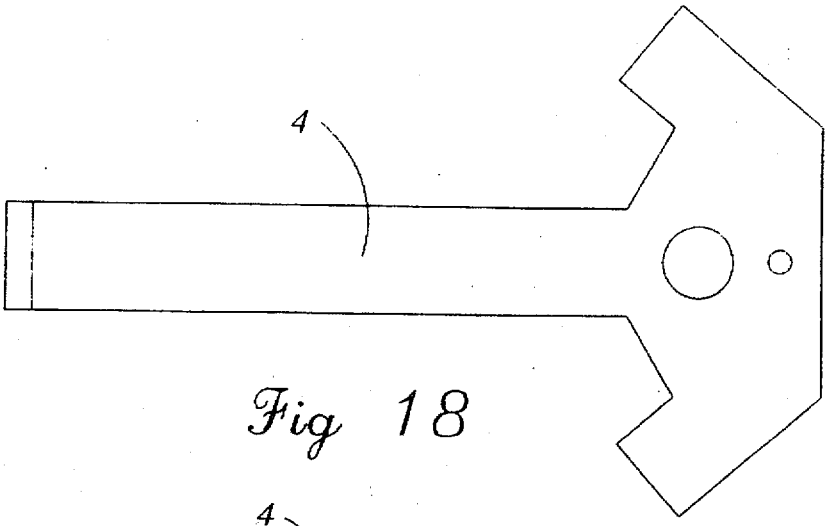
FIG. 18 is a side view of the central rib.
Figure 17:
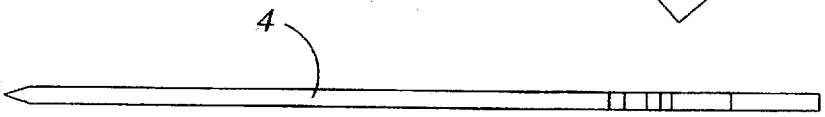
FIG. 17 is a top view of the central rib, the dual knife edge reflects how it will match the point of both fluke planes at the point.
Figure 16:
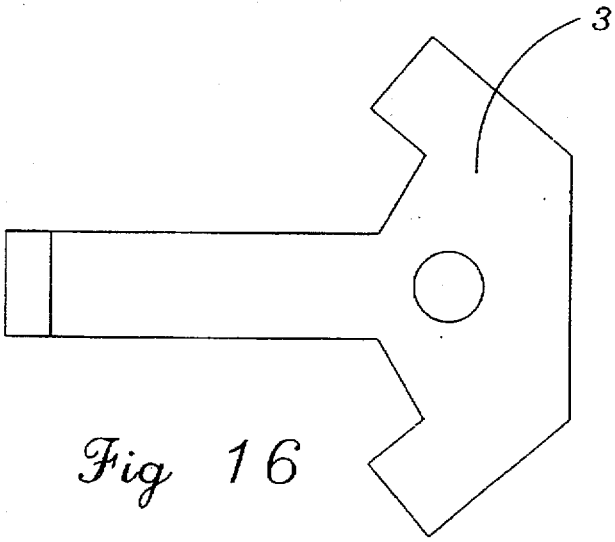
FIG. 16 is a side view of the intermediate ribs.

FIG. 16 is a side view of the intermediate ribs (3). FIG. 17 is a top view of the central rib (4); this view also shows the double cut edge and how it coincides with the point of the fluke planes (12). FIG. 18 shows a side view of the central rib (4). The larger of the two holes is for the shall and the smaller of the two holes is the attachment point where a shackle would fix the pennant/buoy line to the back of the anchor for retrieval.

Figure 20:
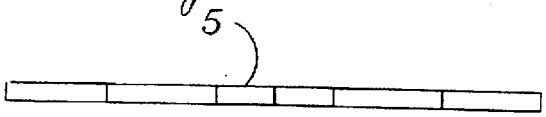
FIG. 20 is a top view of the outer plate of stops.
Figure 19:
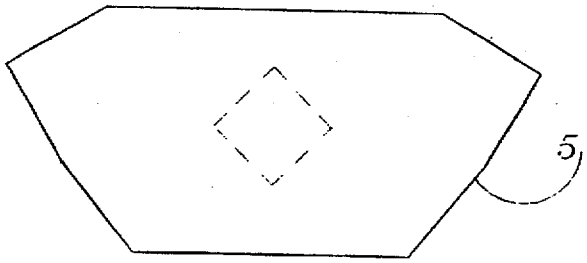
FIG. 19 is a side view of the outer plate of stops.

FIG. 19 is a side view of the outer plate of stops (5), the square holes is to facilitate the welding of the shaft (8). FIG. 20 is a top view of the outer plate of stops (5).

Figure 21:
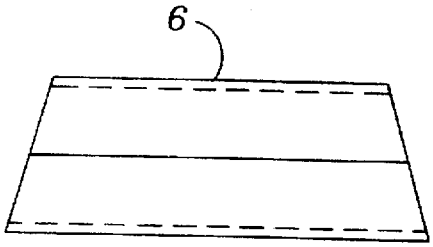
FIG. 21 is a side view of the angular reinforcement piece.
Figure 22:
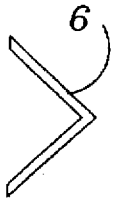
FIG. 22 is a top view of the angular reinforcement piece.

FIG. 21 is a side view of the angular reinforcement piece (6) that is welded to the outer plate of stops (5) to finish out the construction on each side. FIG. 22 is a top view of the angular reinforcement piece (6).

Figure 25:
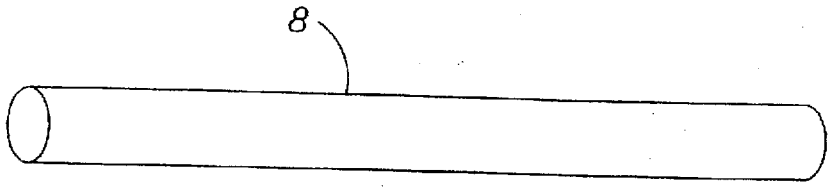
FIG. 25 is an oblique or isosceles view of the shaft.
Figure 23:
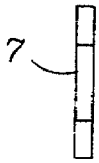
FIG. 23 is a top view of the washer.
Figure 24:
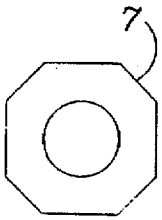
FIG. 24 is a side view of the washer.

FIG. 23 and FIG. 24 show the top and side view of the washer (7). FIG. 25 is an oblique or isosceles view of the shaft (8).

Figure 26:
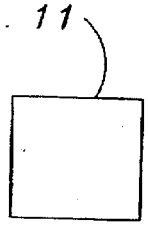
FIG. 26 is a side view is the stops spacer plate.
Figure 27:
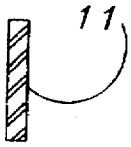
FIG. 27 is a top view of the stops spacer plate.

FIG. 26 and FIG. 27 are the side and top views of the stops spacer plates (11) that fit between the vertical ribs (2, 3, 4) and form the back side of the stops boxed section and also fit between the outer ribs (2) and the outer plate of stops (5) for structural reinforcement when welded out.

Figure 28:
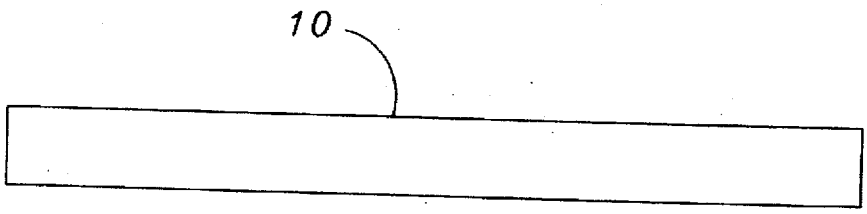
FIG. 28 is a side view if the stops joiner plate.
Figure 29:
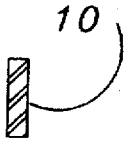
FIG. 29 is an end view of the stops joiner plate.

FIG. 28 and FIG. 29 show a top and side view of the stops joiner plate (10) that are the top and bottom portions of the boxed shape of the stops.

Figure 30:
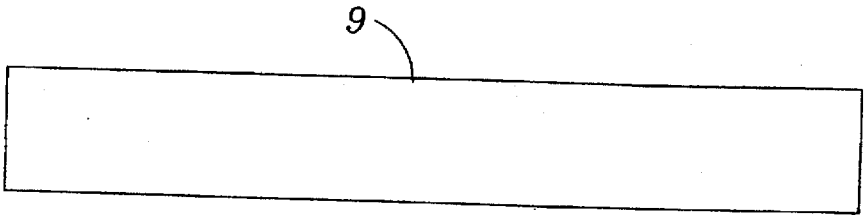
FIG. 30 is a side view of the face of stops plate.
Figure 31:
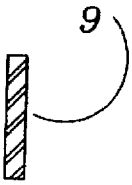
FIG. 31 is an end view of the face of stops plate.

FIG. 30 and FIG. 31 are the top and side views of the face of stops plate (9) that when welded out form the complete stops of the Maxine Bi-Plane Anchor.

I claim:

1. An anchor for positioning marine vessels in a body of water, comprising:

a) a fluke including a pair of parallel plates spacedly interconnected by a plurality of ribs defining a plurality of parallel open passages extending through the fluke and permitting the flow of marine floor material therethrough, b) bale means hingedly connected on the sides of the flake, and c) stops means limiting the pivoting of the bale means relative to the fluke.

2. An anchor as claimed in claim 1, wherein the bale means is located exteriorly of the area of the fluke.

3. An anchor as claimed in claim 1, wherein the side elevation of the stop means relative to the bale means assists in the burying of the anchor.

* * * * *